United States Patent [19]

Bahder

[11] 4,372,988

[45] Feb. 8, 1983

[54] EXTENSION OF CABLE LIFE

[75] Inventor: George Bahder, Edison, N.J.

[73] Assignee: Cable Technology Laboratories, Inc., New Brunswick, N.J.

[21] Appl. No.: 239,220

[22] Filed: Mar. 3, 1981

Related U.S. Application Data

[63] Continuation of Ser. No. 5,321, Jan. 22, 1979, abandoned.

[51] Int. Cl.[3] ..... B05D 5/00

[52] U.S. Cl. ..... 427/52; 427/117; 427/120; 427/316; 174/25 R; 174/25 C; 156/48

[58] Field of Search ..... 156/48, 94, 51, 52, 156/56; 174/25 R, 25 C, 25 G, 116 V, 116 PM, 107, 120 SR; 427/117, 120, 316, 52; 264/174

[56] References Cited

U.S. PATENT DOCUMENTS

| | | | |
|---|---|---|---|
| 3,252,834 | 5/1966 | Vincent | 156/48 |
| 3,634,560 | 1/1972 | Anderson | 156/94 |
| 3,711,309 | 1/1973 | Packo | 156/94 |
| 4,042,776 | 8/1977 | Matsuba et al. | 174/107 |
| 4,237,172 | 12/1980 | Packo et al. | 156/94 |

FOREIGN PATENT DOCUMENTS

| | | | |
|---|---|---|---|
| 44-15454 | 9/1969 | Japan | 174/25 G |
| 52-67781 | 6/1977 | Japan | 174/25 G |
| 53-18712 | 6/1978 | Japan | 174/25 G |

*Primary Examiner*—Michael R. Lusignan
*Assistant Examiner*—Richard Bueker
*Attorney, Agent, or Firm*—Darby & Darby

[57] ABSTRACT

A method and apparatus for retarding electrochemical tree-type decomposition of polyolefin electrical insulation by saturating the insulation with a liquid having high resistivity and a low dielectric constant. The insulation of cables which have already been in service is dried prior to being saturated with the liquid. One embodiment of the invention provides a continuing supply of liquid to the cable after it has been buried underground.

9 Claims, 5 Drawing Figures

EXTENSION OF CABLE LIFE

This is a continuation of application Ser. No. 005,321, filed Jan. 22, 1979 now abandoned.

In recent years, wide use has been made of underground cables for the transmission and distribution of electrical power. Aside from the obvious aesthetic advantages provided by underground power distribution, such underground distribution networks offer relative immunity from damage due to environmental factors such as lightening, high winds, and ice formation. Typical underground distribution networks are comprised of polyolefin-insulated extruded cables. The polyolefin insulation may be comprised of material such as polyethylene, cross-linked polyethylene or ethylene propylene rubber among others. The cables may be directly buried or installed in ducts. Regardless of the method of installation of the cables, they are exposed to fairly high levels of environmental moisture.

It is known that the intermolecular spaces of polyolefin insulation are large, thus rendering such insulation susceptible to the diffusion of molecules of moisture into the spaces. This property of polyolefin insulation renders it susceptible to a type of insulation deterioration known as "electrochemical tree formation." Insulation exhibiting long electrochemical trees may have a breakdown voltage lower than the level of switching surges or the level of operating voltages. The service life of polyolefin cables such as those described above, therefore, may be limited to periods as short as fifteen years due to the electrochemical tree formation phenomenon.

It is also known that the rate of growth of electrochemical trees is greater where a.c. voltages rather than d.c. voltages are applied to the cable. Furthermore, the rate of tree formation and growth increases with an increase of the average and local voltage stresses in the insulation. Tree formation is most likely where there are voids in the insulation in which excessive amounts of moisture tend to accumulate and where imperfections or impurities in the cable tend to create high local field stresses.

Electrochemical trees are believed to be formed in the following manner. Environmental moisture, which has a high dielectric constant and high conductivity, diffuses throughout the insulation layer of the cable via the large intermolecular spaces in the insulation. This moisture forms into droplets, both in the intermolecular spaces and in microvoids and voids which may be present in the body of the insulation. Under electric fields, electrostatic forces acting on the droplets cause them to elongate in the direction of the field. Due to this elongation the radii of the ends of the droplets decrease and the strength of the electric field at these ends consequently increases.

At sufficiently high field strengths small electrical discharges occur at the ends of the droplets causing decomposition of the insulation in the region of these discharges. Moisture enters into the decomposed area of the insulation thereby moving the electrical discharge region further into the insulation. In this manner, an ever enlarging pattern of channels or voids forming an "electrochemical tree" is formed in the insulation, and the breakdown voltage of the insulation in the area of the tree decreases as the size of the tree increases.

Efforts have been made to minimize the treeing effect by reducing the number of imperfections and areas of impurity in the cable at which high local field stresses cause the formation of electrochemical trees to begin. Efforts have also been made to reduce the number of voids within the insulation at which moisture tends to accumulate. None of the above efforts, however, have been successful in reducing the treeing effect to an acceptable level.

It is believed, therefore, that the most effective means for preventing the formation of electrochemical trees, or at least reducing the rate of such tree formation to an acceptable level, is one which prevents environmental moisture from diffusing into the insulation layer of a polyolefin insulated cable.

Moisture impervious coverings such as lead or aluminum sheaths have been used successfully in the past for oil paper insulated cables. For the reasons discussed below, however, the use of such sheaths is not a practical method for preventing moisture from entering the insulation of cables of the solid dielectric type (e.g., polyolefin).

Due to the high coefficient of thermal expansion of solid dielectric insulation, lead or aluminum sheaths must expand to conform to the increased diameter of the cable core which results from the elevated temperature reached under typical operating conditions. When the cable core is returned to a lower temperature, the diameter of the core is reduced. The diameter of the lead or aluminum sheath, however, does not become correspondingly smaller, and a longitudinal channel is thus left between the lead or aluminum sheath and the insulation shield of the cable. If moisture subsequently penetrates the sheath in areas of localized sheath damage, or through pinholes which may appear in the sheath during the manufacturing process, this moisture can flow through this channel along the entire length of the cable, thus making the entire cable susceptible to the formation of electrochemical trees and to corrosion of the sheath.

An additional disadvantage of lead cable sheaths is their susceptibility to the development of an insulating, corrosive layer in the presence of carbon black and small amounts of moisture. Such a layer may lead to electrical discharges occurring between the insulation shield and the lead sheath which can result in premature cable failure. Consequently, in order for a lead sheath to be suitable for use with a solid dielectric cable, the sheath should be in electrical contact with the insulation shield of the cable, but physically separated from it. Such a cable is both difficult and expensive to manufacture. Furthermore, the weight of a cable with a lead sheath renders the transportation and insulation of long lengths of cable so provided difficult.

To overcome the above discussed disadvantages of lead or aluminum sheaths, cable sheaths comprised of longitudinally corregated copper have been utilized in recent years in solid dielectric cables. Cables so comprised do not require expensive manufacturing equipment such as is required for the production of lead sheathed cable. These longitudinally corrugated copper sheaths, however, have an opening extending longitudinally along the entire length of the cable at the overlap area of the sheath. Moisture can enter this opening and diffuse into the insulation layer of the cable. Such a copper sheath cable typically has a polyolefin jacket which is applied over the longitudinally corregated copper sheath. This jacket, however, has a tendency to crack along the line of the overlap when the cable is subjected to high operating temperatures.

Applicant's copending application Ser. No. 005,320, now U.S. Pat. No. 4,256,921, entitled Moisture Resistant Cable, describes a cable having a composite jacket of novel design which prevents moisture from entering the insulation layer of the cable and does not suffer from the previously discussed disadvantages associated with the cable jackets of the prior art. There are, however, a large number of underground polyolefin insulated cables which have been in service for a number of years, and which, consequently, already exhibit electrochemical tree type insulation deterioration. It would be extremely difficult and costly to dig up these cables so that they could be replaced by cables having superior moisture resistance, such as the cable of applicant's copending application.

It has been discovered that the growth of electrochemical trees can be retarded when the intermolecular spaces and the voids existing in the insulation and the voids existing at the interfaces between the insulation and the other elements of the cable are filled with a high resistant, low dielectric constant liquid. This "tree retardant liquid" retards the entry of moisture into the insulation, thereby preventing the formation of electrochemical trees. It has also been found that the useful life of previously installed cables, which already exhibit electrochemical trees, can be extended by an application of the above described liquid if, as a preliminary step, the moisture already existing in the cable is first eliminated. In such a case, the liquid diffuses not only into the intermolecular spaces and voids in the insulation, but also into the already formed tree channels, thereby preventing further elongation of these channels.

A typical electrical cable to which the present invention can be applied is comprised of a stranded electrical conductor which is surrounded by a conductor shield composed of a semiconducting material, a body of polyolefin insulation, a semiconducting insulation shield, a metallic shield and an optional polyolefin jacket.

In accordance with an embodiment of the invention, a tree retardant liquid having good properties of penetration into polyolefin materials is introduced into the stranded conductor from which it diffuses through the conductor shield and polyolefin insulation. The introduction of the liquid takes place at the time of the installation of the cable.

In another embodiment of the invention a previously installed cable is dried before introducing the tree retardant liquid into the stranded conductor.

In still a third embodiment of the invention a reservoir is provided for supplying tree retardant liquid to the conductor thereby replenishing the supply of tree retardant liquid which diffuses out of the insulation material during the life of the cable.

It is an object of the present invention, therefore, to provide a method for preventing the formation of electrochemical trees in a polyolefin insulated cable thereby increasing the effective service life of the cable.

It is a further object of the invention to provide a method of treating previously installed cables, which already exhibit electrochemical trees, so that the breakdown voltage lowering effect of these trees is negated, thereby extending the service life of such a cable.

It is a still further object of the invention to provide a cable system which is relatively immune to electrochemical tree formation in the presence of environmental moisture.

The above objects and further objects, advantages and features of the present invention will be apparent from a consideration of the following description in conjunction with the appended drawings in which.

Figure 1:
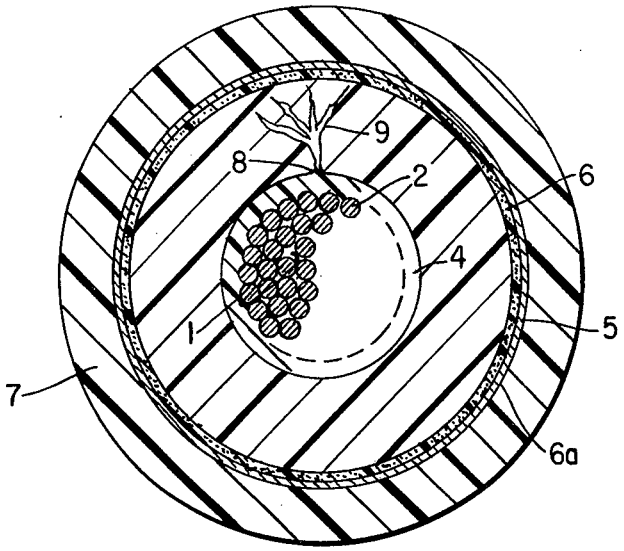
FIG. 1 is a cross-section of a polyolefin insulated extruded cable in which electrochemical trees have formed in the insulation.

FIG. 1 shows a cross-section of a typical polyolefin insulated extruded cable to which the present invention is applicable. The conductor 1 of the cable is comprised of a plurality of strands 2 of, for example, copper wire. Surrounding the conductor 1 is a semiconducting conductor shield 4 which typically is comprised of a carbon filled plastic or thermoset material having a thickness of about 30 mils. It will be noted that interstices 10 exist between the conductor 1 and the conductor shield 4, and also between the individual strands 2 of the conductor. Surrounding the conductor shield 4 is a body of polyolefin insulation 5 which is comprised of a material such as polyethylene, cross linked polyethylene, or ethylene propylene rubber. The body of insulation 5 is, in turn, surrounded by a semiconducting insulation shield 6 and by metallic shield **6*a* consisting, for example, of wires, or flat or corragated metallic ribbons or tapes. The metallic shield 6*a* may, optionally, be covered by a polyolefin jacket 7**.

As has been previously discussed, cables of the type illustrated by FIG. 1 are susceptible to the formation of electrochemical trees when environmental moisture diffuses into the intermolecular spaces existing in polyolefin insulation and the insulation is then subjected to high voltage stresses. These stresses are strongest in regions of the cable having imperfections such as contaminants or protrusions such as the region indicated by the numeral 8 of FIG. 1. Under the effect of these stresses, the droplets of moisture, which have a high dielectric constant and high conductivity, are caused to become elongated in the direction of electric field due to the electrostatic forces acting upon them. Due to this elongation, the radii of the ends of these droplets decrease and the intensity of the electrical fields at these ends increases. At a sufficiently high level of field strength an electric discharge takes place at the ends of the droplets. Under a.c. voltage conditions, such as those present in modern underground power distribution systems, these discharges occur even more frequently. These electric discharges cause the insulating material closest to the ends of the droplets to decompose. Additional moisture subsequently flows into the region of decomposition. As this decomposition process continues, small channels or voids are formed in the insulation in a "tree" pattern. Such an "electrochemical tree" is represented, in greatly magnified form, in the area indicated by the numeral 9 of FIG. 1.

It has been discovered that the growth of such electrochemical trees is retarded when the intermolecular spaces in the insulation and the voids and imperfections existing in the insulation and at the interface between the conductor shield and the insulation and between the insulation and the insulation shield are filled with a high resistant, low dielectric constant liquid. This "tree retardant" liquid retards the entry of moisture into the insulation thereby preventing the formation of electrochemical trees. It will be appreciated that only liquids having a low molecular weight and which, consequently, penetrate easily into the insulation structure, are suitable for this purpose. It will be noted, however, that if the molecular weight of the liquid is too low, it will quickly diffuse out of the insulation thereby allowing the insulation to again become susceptible to electrochemical tree formation.

Experiments have been performed to determine the effect of saturating polyolefin insulated cables with various liquids upon the formation and growth of electrochemical trees in these cables. The liquids tested included glycerol, silicon fluid, ethylene glycol, triethylene glycol, neozone 4, anthricine, dimethyl silane, and ferrocine. Each test consisted of subjecting a control sample of cable and a tree retardant liquid treated test sample of cable to an "accelerated life" test. The control sample was a length of polyolefin insulated extruded cable of the type described above, in which the insulation was exposed to moisture by immersing the sample in water and by filling the conductor with water during the test. The test sample was a similar length of cable which was treated by filling its conductor with the liquid to be tested and then subjecting the cable to five temperature cycles ranging from room temperature to 100° C. After the above treatments both cable samples were maintained in water at approximately 70° C. and at a voltage stress of 80 volts per mil at 8000 Hz. for 30 days. After 30 days, slices were taken of the insulation of both samples, and the number and length of the trees therein were recorded. It is believed that an accelerated life test such as the one described above corresponds to five to ten years of cable operation under typical conditions.

Figure 2:
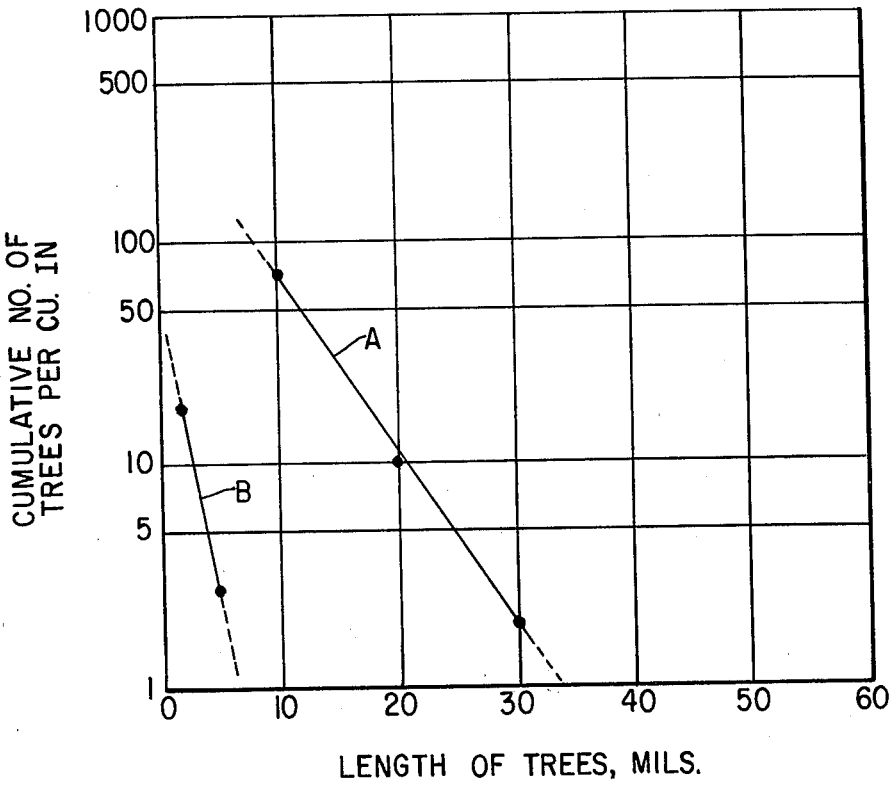
FIG. 2 is a graph illustrating the results of an experiment to determine the effect of saturating the polyolefin insulation with a tree retarding liquid upon the formation and growth of electrochemical trees.

FIG. 2 is a graph illustrating the results of an experiment in which the test sample was saturated with triethylene glycol. The results of the experiment indicated that this compound is particularly suitable for use as a tree retardant liquid. The graph shows the number of trees of each particular tree length found per cubic inch of insulation in the control sample (curve A) and the test sample (curve B). It will be noted that the number of trees found in the triethylene glycol saturated test sample was appreciably lower than the number found in the control sample. Furthermore, the average length of trees which were found in the test sample was appreciably less than the average length of the trees found in the control sample.

The results of similar experiments indicated that dimethyl silane (trade name DC-200-50), and ethylene glycol were also suitable for use as tree retardant liquids. The above liquids are mentioned as examples only, however, since it is believed that any liquid having the properties of high resistivity (e.g., above $10^9$ ohms per centimeter), low relative dielectric constant (e.g., below 20), and good properties of penetration into polyolefin insulation, would be suitable for use as a tree retardant liquid.

In accordance with the present invention, therefore, the insulation of a polyolefin-insulated cable may be saturated with a tree retardant liquid such as the ones described above. The insulation so treated is thus highly resistant to the entry of moisture therein and is thereby resistant to the formation of electrochemical trees.

A preferred method of saturating the insulation is by introducing tree retardant liquid into the stranded conductor 1 of the cable. The liquid flows along the entire length of the cable via the interstices 10 between the strands of the conductor (see FIG. 1). The liquid eventually fills these inter-strand interstices 10 and also fills any voids existing in the insulation 5, or at the interface between the conductor shield 4 and the insulation 5. The liquid also diffuses through the insulation 5, thereby filling the intermolecular spaces in the insulation and any voids existing between the insulation 5 and the insulation shield 6.

It will be noted that the above described method for saturating the insulation of a cable with tree retardant liquid is particularly advantageous where the cable to be treated is already in service (buried underground). In such a situation, exposure of the entire cable could prove to be both difficult and prohibitively expensive. The above method, however, requires only that the ends or terminals of the cable be exposed so that liquid may be introduced into the ends of the conductor of the cable.

It will be appreciated that introduction of the liquid into the cable conductor in the manufacturing plant is not practical because a substantial part of the liquid would be lost during handling and installation of the cable. Such liquid loss would be the result of liquid flowing out of the ends of the cable conductor and diffusing through and out of the insulation. Furthermore, presence of the liquid would create serious problems in the splicing and termination of the cables. The preferred time for the introduction of liquid into new cable is, therefore, at a time during the installation of the cable after the splicing and termination operations have been accomplished.

Figure 3:
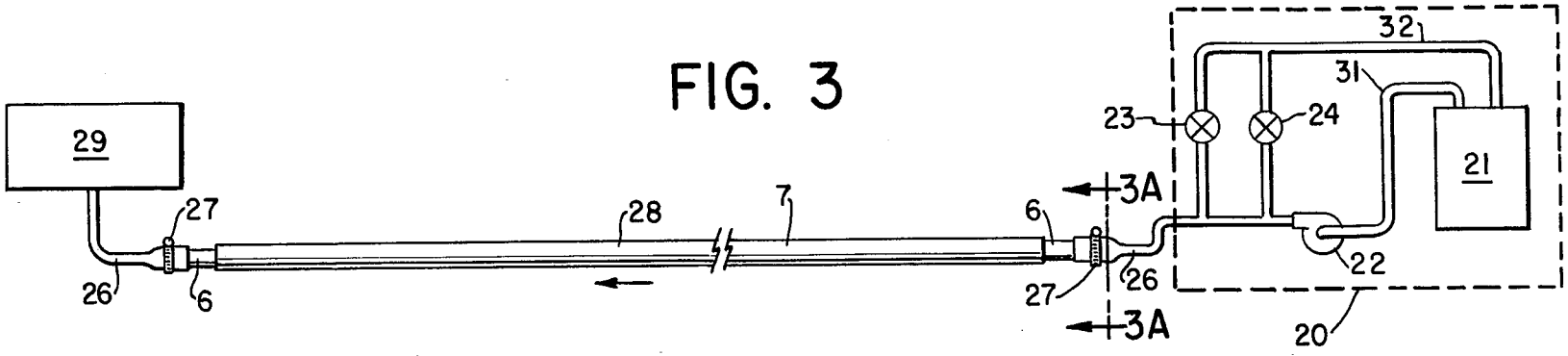
FIG. 3 shows a cable connected to an apparatus for drying the cable and introducing tree retardant liquid therein.

FIG. 3 shows an illustrative embodiment of a pressurized liquid supply apparatus which may be used for filling a cable with tree retardant liquid at the time of the installation of the cable. It will be noted that the liquid could, alternatively, be gravity fed to the cable. The use of an apparatus such as the one illustrated by FIG. 3, however, greatly reduces the time necessary to fill the cable as compared to the time which would be necessary if pressurized means were not used.

The embodiment shown in FIG. 3 includes a liquid supply apparatus 20 which may be used to fill a cable 28 with with tree retardant liquid. The liquid supply apparatus 20 includes a liquid supply tank 21 which contains a supply of tree retardant liquid. The liquid supply tank 21 is connected to the input side of a pump 22 via a tank output tube 31. The output side of pump 22 is connected to a supply valve 25, a pressure relief valve 23, and a by-pass valve 24. The other sides of pressure relief valve 23 and by-pass valve 24 are connected back to the liquid supply tank 21 via a tank input tube 31. The supply valve 25 is connected to an end portion of the cable 28 via a flexible tube 26.

Figure 3A:
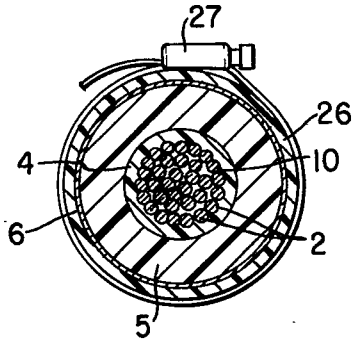
FIG. 3A is a transverse section at a line A—A of FIG. 3.

Flexible tube 26 may comprise any suitable plastic material and is fitted over an end portion of the cable. In cables having a cable jacket 7 such as the one illustrated by FIG. 3, the jacket should be stripped back to allow the tube 26 to be fitted over the insulation 5 or insulation shield 6 of the cable. The plastic tube 26 may be secured to the insulation 5 or insulation shield 6 by means of a conventional worm clamp 27 (see FIG. 3A).

In operation, tree retardant fluid is drawn from the supply tank 21 by the pump 22. Pump 22 pressurizes the liquid and supplies it to the input port of supply valve 25. When supply valve 25 is opened, the pressurized liquid passes through tube 26 to the conductor of the cable. In the manner previously discussed, the liquid then flows through the inter-strand interstices 10 in the conductor 1 and diffuses through the insulation 5 of the cable. Eventually the entire cable and its insulation become saturated with tree retardant liquid.

Pressure relief valve 23 is set to open if the pressure of liquid supplied to the cable approaches a level at which damage to the cable could occur. When pressure relief valve 23 opens liquid is drained from the cable back to the supply tank 21, thereby decreasing the pressure applied to the cable before the cable can be damaged.

By-pass valve 24 provides manual means for depressurizing the system such as would be desirable upon completion of the cable filling operation.

The time necessary for filling the cable with liquid may be further reduced by applying a vacuum to the end of the cable opposite the end attached to the liquid supply apparatus 20. FIG. 3 illustrates a vacuum being so applied by a vacuum pump 29 which is attached to the cable by means of another flexible tube 26 in a manner similar to that in which the liquid supply apparatus 20 is attached.

The treatment of polyolefin insulated high voltage cables with tree retardant liquid, in the manner described above, can be of particular benefit in cases where the cable has been in service for several years and already exhibits an appreciable number of electrochemical trees of significant length. In such cases the liquid fills the channels of the trees which have already formed thereby increasing the dielectric strength of the insulation. Further growth of of the trees is also retarded, and the useful life of the cable is thereby increased.

Before treating a cable which has been in service for several years with tree retardant liquid the moisture already existing within the cable should be removed. This drying of the cable may be accomplished by heating the conductor of a cable to a temperature preferably in the range of between 100° C. and 105° C. Such heating may be accomplished by passing an electric current through the conductor. Further drying may be accomplished by passing a desiccative gas or liquid, such as dry nitrogen, through the conductor.

As has been previously discussed, a liquid suitable for use as a tree retardant liquid must be of sufficiently low molecular weight so as to have good penetration characteristics into polyolefin materials. Unfortunately, such a liquid will eventually diffuse out of the cable through the polyolefin insulation thereby leaving the cable again susceptible to electrochemical tree formation. This effect may be minimized, however, in accordance with an aspect of the present invention, whereby a continuing supply of tree retardant liquid is provided along with the cable at the time of installation.

Figure 4:
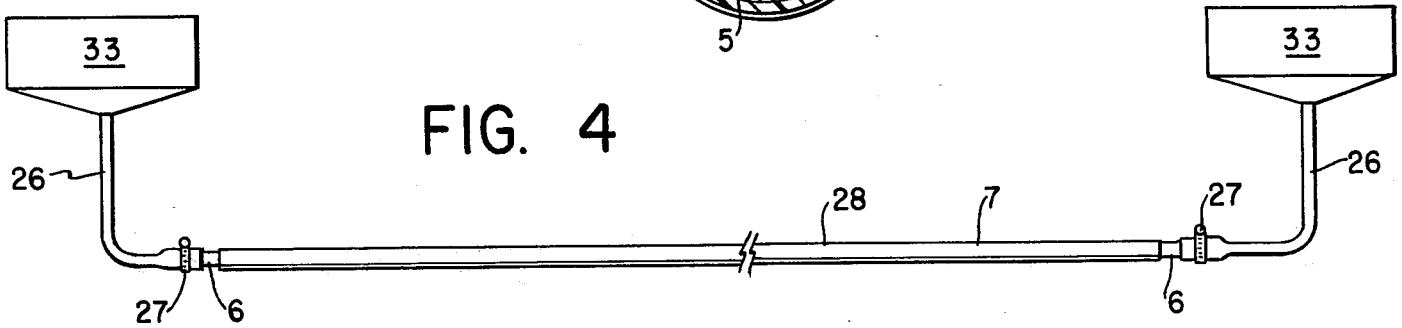
FIG. 4 shows an apparatus suitable for burial with the cable for providing a continuing supply of tree retardant liquid to the cable after installation.

Referring to FIG. 4, there is shown a cable to which fluid reservoirs 33 are attached at both ends. The reservoirs 33 are suitable for burial with the cable and may be pressurized or non-pressurized, pressurization being, however, preferred. As fluid is lost from the cable by diffusion through its polyolefin insulation, the supply of fluid within the cable is replenished from the reservoirs 33. The reservoirs may be formed, for example, of polyolefin insulation material. The reservoirs may comprise a portion of a conventional cable terminal.

It will be understood that the foregoing description of preferred embodiments of the present invention is for purposes of illustration only, and that the various structural and operational features as herein disclosed are susceptible to a number of modifications and changes none of which entail any departure from the spirit and scope of the present invention as defined in the hereto appended claims.

What is claimed is:

1. A method for the in situ repair of an underground high voltage electrical cable for extending the life thereof, said cable including a stranded conductor and a polyolefin insulation having at least one electrochemical tree formed therein, said method being effective to counterbalance the deleterious effect of said electrochemical trees on the electrical properties of said insulation while preventing the growth of said trees, said method comprising the steps of:

drying said cable; and continuously introducing an electrochemical tree retardant liquid to said conductor so as to cause said liquid to diffuse along said conductor between the strands thereof and into said insulation layer so as to fill said trees;

said electrochemical tree retardant liquid being a liquid having the properties of resistivity in excess of $10^9$ ohms per centimeter, a relative dielectric constant below 20, and sufficiently low molecular weight to permit ready penetration into polyolefin insulation, said molecular weight being sufficiently high to prevent rapid diffusion out of said insulation entirely.

2. The method of claim 1 wherein said drying step comprises heating the cable by passing an electrical current through the conductor of said cable.

3. The method of claim 1 wherein said drying step comprises:

passing a desiccative fluid through the conductor of the cable.

4. The method of claim 3 wherein said fluid comprises nitrogen.

5. A method for in situ repairing and extending the service life of the insulation of an underground high voltage electrical cable including a stranded conductor and an extruded polyolefin insulation layer in which a plurality of electrochemical trees have formed in said extruded insulation layer, said method comprising the sequential steps of:

drying said cable; and continuously supplying an electrochemical tree retardant liquid to said conductor, said liquid continuously diffusing through said extruded insulation layer saturating said layer, filling said trees, and preventing moisture from diffusing into said insulation, said liquid consisting essentially of a material selected from the group consisting of dimethyl silane, ethylene glycol, triethylene glycol and combinations thereof.

6. The method of claim 5 in which said supplying step comprises:

introducing a pressurized supply of said liquid into one end portion of said conductor; and applying a vacuum to a second end portion of said conductor.

7. The method according to claim 5 wherein said electrical cable consists essentially of a stranded conductor, an extruded polyolefin insulation layer, and a moisture permeable metallic shield.

8. The method according to claim 5 wherein said drying step is accomplished by continuously supply a desiccative fluid to the conductor.

9. A method for continuously preventing the diffusion of moisture into the extruded polyolefin insulation of an installed underground high voltage electrical cable including a stranded conductor, an extruded polyolefin insulation layer having a plurality of electrochemical trees and a moisture permeable metallic shield, said method comprising the sequential steps of:

drying said cable; and continuously supplying an electrochemical tree retardant liquid to at least one end of the operating cable conductor for diffusing throughout said insulation layer and filling said electrochemical trees, said liquid consisting essentially of a material selected from the group consisting of dimethyl silane, ethylene glycol, triethylene glycol and combinations thereof.

* * * * *